United States Patent [19]

Del Pozzo

[11] 4,053,132

[45] Oct. 11, 1977

[54] SHELF SUPPORT

[76] Inventor: James Anthony Del Pozzo, 155 Colonel Bell Drive, Brockton, Mass. 02403

[21] Appl. No.: 711,773

[22] Filed: Aug. 5, 1976

[51] Int. Cl.[2] ..... A47B 96/06

[52] U.S. Cl. ..... 248/235; 108/109; 211/134; 248/250

[58] Field of Search ..... 248/235, 243, 250, 239; 108/109; 211/134; 292/19, 69, 70, 253, 303, 334, 341, 342, DIG. 10, DIG. 15, DIG. 20, DIG. 16, DIG. 38, 76

[56] References Cited

U.S. PATENT DOCUMENTS

| | | | |
|---|---|---|---|
| 1,068,886 | 7/1913 | Gamble | 292/76 |
| 2,839,350 | 6/1958 | Hill et al. | 248/250 |
| 3,302,965 | 2/1967 | Hasth et al. | 292/76 |
| 3,471,112 | 10/1969 | MacDonald et al. | 248/250 X |
| 3,476,426 | 11/1969 | Lewin | 292/76 |
| 3,801,143 | 4/1974 | Gutner | 292/76 |
| 3,870,266 | 3/1975 | MacDonald | 248/235 |

FOREIGN PATENT DOCUMENTS

| | | | |
|---|---|---|---|
| 184,844 | 6/1955 | Austria | 292/76 |

*Primary Examiner*—J. Franklin Foss
*Attorney, Agent, or Firm*—Kenway & Jenney

[57] ABSTRACT

A unitary shelf support and retainer is disclosed and includes means for mounting the unit on a cabinet wall, a surface for supporting the cabinet shelf, and an upright portion extending along the wall of the cabinet and including a smoothly curved deformable web of resilient material. As the shelf is installed, that web is deformed to a degree permitting the shelf to slip past the web to be supported by the shelf support surface. After the shelf has passed the deformable web, it returns to its original shape, owing to its resilient nature, in position to retain the shelf in place.

12 Claims, 5 Drawing Figures

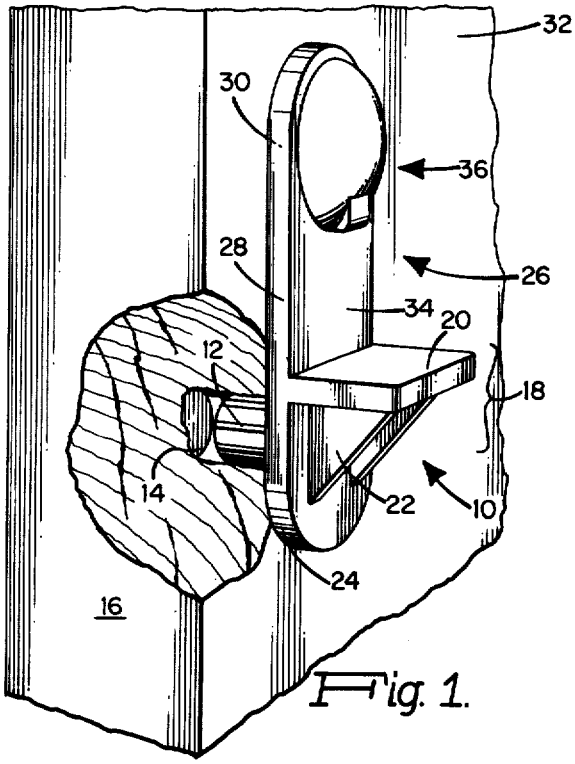
Fig. 1.
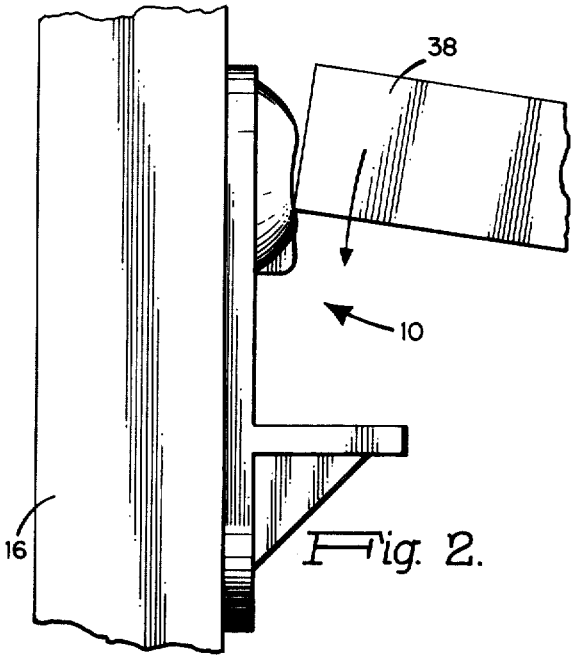
Fig. 2.
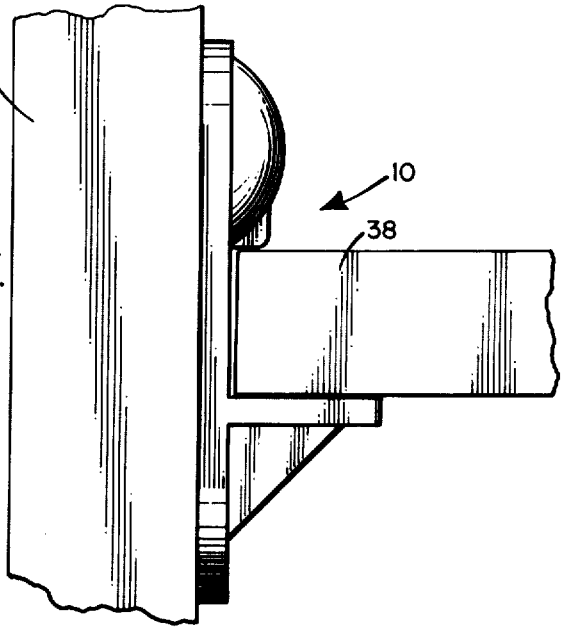
Fig. 3.
Fig. 4.
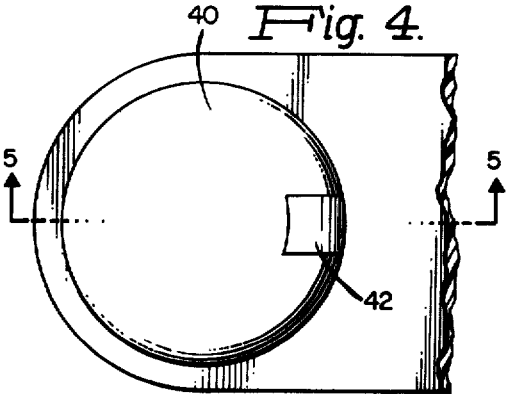
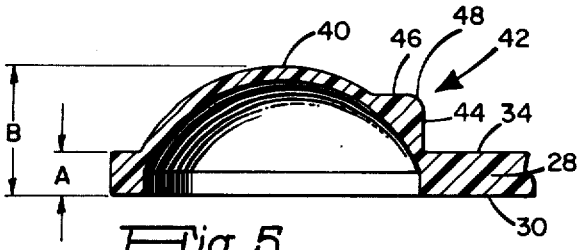
Fig. 5.

SHELF SUPPORT

BACKGROUND OF THE INVENTION

The present invention relates to a device for supporting, and retaining, a shelf in a cabinet. (As used herein, the word "cabinet" is intended to include any structure that supports shelves—e.g., kitchen cabinets, bookcases, etc.)

The shipping of cabinets having internal shelves has historically presented a problem. Thus, with shelf supports that did not also positively retain the shelf in place, the jostling that the cabinets receive during shipment could cause the shelf to bounce around within the cabinet with consequent damage both to the cabinet structure and to the shelf. It has been proposed to provide a combination support and anchor (e.g., MacDonald, U.S. Pat. Nos. 3,471,111; MacDonald et al, 3,471,112; Dowell, 1,918,457) in order to prevent movement of the shelves within the cabinet. Typically, such devices have involved essentially one-way mechanisms (e.g., see MacDonald and MacDonald et al) that permit installation of the shelf, but that retain the shelf at the expense of convenient removal. Such removal is often desirable at the destination of the cabinet being shipped, since the purchases may want a different spacing between shelves than that chosen by the manufacturer prior to shipping. With such one-way devices, of course, shelf removal (necessary to permit removal and reinstallation of the shelf support devices) is difficult.

OBJECTS AND SUMMARY OF THE INVENTION

In view of the above discussion, it is a principle object of the present invention to provide a shelf supporting and retaining unit that permits convenient removal of a shelf.

To this end, the invention features a shelf support device that includes a surface for receiving a shelf edge portion, an integral upright portion, and means for mounting the device on a cabinet wall. The upright portion includes a first surface for engagement with a cabinet wall, a second surface opposite the first surface, and a shelf retainer structure comprising a generally smoothly curved deformable web of a resilient material that projects from the second surface. The resiliently deformable web, which is preferably in the shape of a spherical segment and is integral with the remainder of the upright portion around the complete circumference thereof, permits passage of the shelf therepast in either direction upon the application of sufficient force. In one preferred embodiment, an integral tab portion is provided adjacent a lower edge of the spherical web. That tab portion abuts a supported shelf and, while still permitting removal of the shelf, is effective to require a greater force for shelf removal than for shelf installation.

BRIEF DESCRIPTION OF THE DRAWINGS

Other objects, features, and advantages of the invention will appear from the following description of a particular preferred embodiment, taken together with accompanying drawings, in which:

FIG. 1 is a perspective view and FIGS. 2 and 3 are side elevations of a shelf support and retainer device constructed according to the present invention and mounted on a cabinet wall, the three figures showing various stages in the installation of a shelf;

FIG. 4 is a plan view of a retainer portion of the device illusrtated in FIGS. 1—3; and FIG. 5 is a sectional view taken at 5—5 of FIG. 4.

DETAILED DESCRIPTION OF A PARTICULAR PREFERRED EMBODIMENT

Referring to FIGS. 1—3, an integral shelf support and retainer device 10 is preferably injection molded from a modified polypropylene material having a rubber constituent for increased resiliency. The device 10 includes a mounting stud 12 to be received in a mounting opening 14 provided in a cabinet wall 16. A support portion 18 includes an upwardly facing support surface 20, preferably braced by bracing webs 22 integral with both portion 18 and a downwardly projecting web portion 24. An upright portion 26 of the device comprises a web 28 which is an extension of the web 24, has a first flat surface 30 disposed to abut a vertical surface 32 of the cabinet wall 16 and a second surface 34 opposite the surface 30. A shelf retainer 36 projects from the surfce 34 at a location spaced apart from the support surface 20 substantially by the thickness of a shelf 38.

Referring to FIGS. 4 and 5, the retainer portion 36 comprises a bubble, or dome, 40 projecting outwardly from the surface 34 and integral with the web 28 around the entire circumference of the dome. The dome 40 can be essentially a segment of a sphere (e.g., slightly less than a hemisphere). In the preferred embodiment illustrated, a small tab 42 is provided integral with the dome 40 at a peripheral portion of the dome facing the support surface 20. The tab 42, which essentially provides a thicker, less flexible retainer segment, is generally triangular in cross-section including surfaces 44, 46 that are connected by an intermediate rounded surface portion 48.

In the illustrated embodiment formed from a modified polypropylene, the thickness "A" of web portion 28 is approximately 0.27 inch, the thickness of the web of the dome 40 is approximately 0.046 inch, and the projection of the dome web 40 above the surface 30 (see "B" in FIG. 5) is approximately 0.1 inch.

Referring again to FIGS. 1—3, with the device 10 mounted on the cabinet wall 16, a shelf 38 is manually forced downwardly so as to deform, and partially collapse, the dome 40. (see FIG. 2). The depression of the web of dome 40 permits the shelf 38 to squeeze past the retainer structure 36 in a position (see FIG. 3) to be supported on the support surface 20 and retained against undesired upward movement by the retainer portion 36. Removal of the shelf 38 is accomplished by an upward manual force against the lower surface of shelf 38 adjacent the device 10 (e.g., striking the lower surface of the shelf with the heel of one's hand). Such force initiates the deformation of the retainer portion 36 and permits the shelf to slip past the curved surface 48 of tab 42 and subsequently by the remainder of the retainer portion. The greater rigidity in the lower portion of the dome web 40 provided by the tab 42 requires a greater initial force for shelf removal than would be required for shelf installation. Nonetheless, convenient removal of the shelf is still possible, without special tools or without requiring the assistance of other individuals.

The resilient deformability of the smoothly curved dome web 40 is thus conducive to both the convenient installation and removal of a shelf 38. Naturally, the precise degree of resilient deformability can be varied by varying the web thickness of the dome 40, by varying the material from which the device is manufactured, etc.

While a particular preferred embodiment of the invention has been illustrated in the accompanying drawings and described in detail herein, other embodiments are within the scope of the invention and the following claims.

What is claimed is

1. A shelf support device for supporting a shelf on a cabinet wall, the device comprising:

a support portion having a surface for receiving a shelf edge portion;

an upright portion including a first surface for engagement with a cabinet wall, a second surface opposite said first surface, and a shelf retainer comprising a generally smoothly curved deformable web of resilient material that projects from said second surface at a location spaced apart from said support portion; and means for mounting the device on a cabinet wall.

2. The shelf support device of claim 1 wherein said smoothly curved surface has the shape of a segment of a sphere.

3. The shelf support device of claim 2 wherein said deformable web is integral with said upright member around substantially the entire periphery of said spherical segment.

4. The shelf support device of claim 3 formed as a unitary structure from a polypropylene material, said deformable web having a thickness of about 0.040 inch to about 0.050 inch.

5. The shelf support device of claim 4 wherein said spherical segment has a maximum projection from said second surface of about 0.17 inch.

6. The shelf support device of claim 3 wherein said shelf retainer further comprises a tab integral with, and projecting from the exterior surface of, said spherical segment at the region thereof closest to said support portion.

7. The shelf support device of claim 6 formed as a unitary structure from a polypropylene material, said deformable web having a thickness of about 0.040 inch to about 0.050 inch.

8. The shelf support device of claim 7 wherein said spherical segment has a maximum projection from said second surface of about 0.17 inch.

9. The shelf support device of claim 8 wherein said tab has a maximum projection from said second surface less than that of said spherical segment.

10. The shelf support device of claim 6 wherein said tab is a generally triangular wedge having a first side generally parallel to said support portion, a second side generally parallel to said upright portion's second side, and a third side integral with said spherical segment.

11. The shelf support device of claim 10 wherein a rounded surface is disposed intermediate said tab's first and second surfaces.

12. The shelf support device of claim 11 wherein said tab has a maximum projection from said second surface less than that of said spherical segment.

* * * * *